US006620018B1

(12) United States Patent
Chao et al.

(10) Patent No.: US 6,620,018 B1
(45) Date of Patent: Sep. 16, 2003

(54) FLYING TOY DEVICE INCLUDING SIMULATED FAN JET PROPULSION SYSTEM

(76) Inventors: Justin Chao, 1070 Esplanade Pl., Walnut Creek, CA (US) 94596; Joseph Tean, 1070 Esplanade Pl., Walnut Creek, CA (US) 94596

( * ) Notice: Subject to any disclaimer, the term of this patent is extended or adjusted under 35 U.S.C. 154(b) by 0 days.

(21) Appl. No.: 09/838,508

(22) Filed: Apr. 19, 2001

(51) Int. Cl.[7] ..... A63H 27/04
(52) U.S. Cl. ..... 446/31; 446/30
(58) Field of Search ..... 446/30, 31, 33, 446/56, 57, 230, 231, 34, 35

(56) References Cited

U.S. PATENT DOCUMENTS 3,087,257 A * 4/1963 White ..... 434/15
3,796,005 A * 3/1974 Chang et al. ..... 446/484
4,067,139 A * 1/1978 Pinkerton et al. ..... 446/31
4,133,139 A * 1/1979 Stanzel ..... 446/31
4,573,937 A * 3/1986 Stanzel ..... 446/31
5,915,650 A * 6/1999 Petrovich ..... 244/46

* cited by examiner

*Primary Examiner*—Derris H. Banks
*Assistant Examiner*—Bena B. Miller
(74) *Attorney, Agent, or Firm*—Reed Smith Crosby Heafey LLP

(57) ABSTRACT

A simulated jet fan is mounted inside a flying toy to provide propulsion. A tether attached to a mounting plate and the flying toy directs the flying toy in a circular motion. In one embodiment, the simulated jet fan is an impeller enclosed in a housing. The impeller is attached to an electric motor powered by batteries. The flying toy includes air inlets coupled to an air intake of the fan, and exhaust ports direct air expelled from the fan toward a rear of the flying toy, providing propulsion. Wings may be attached to the toy to assist in "flying." The attached wings may be fixed or moveable. In one embodiment, flapping wings powered by an electric motor are attached giving the flying toy additional propulsion and a pleasing nature.

7 Claims, 9 Drawing Sheets

FLYING TOY DEVICE INCLUDING SIMULATED FAN JET PROPULSION SYSTEM

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of Invention

The present invention relates to entertainment devices such as Flying toys. The invention is more particularly related to flying toys that are tethered to a fixed point so as to move in a circular pattern.

2. Discussion of Background

Toy airplanes that fly around a centrally located pylon have been very popular with children. For the most part, such toy airplanes have included complex mechanical linkages to obtain simulated flying of the toy airplane. In other cases, the propeller was driven and the wings provide the necessary lift to fly the airplane. In some such toy airplane systems, one motor is utilized to rotate the tethered airplane with another motor utilized to control the propeller of the airplane.

SUMMARY OF THE INVENTION

The present inventors have realized that current propulsion systems for flying toy devices can be improved via the use of an enclosed air propulsion system. The present invention includes the addition of a simulated fan jet type enclosed propulsion system mounted in the body of a flying toy.

The enclosed simulated fan jet is a safe propulsion system compared to rotating propellers or other devices known in the prior art. The improvement provides propulsion for the flying toy without exposed moving parts, and provides an element of a "jet age" high tech to the flying toy. In one embodiment, the simulated fan jet propulsion system is the only propulsion of the flying toy. In another embodiment, the simulated fan jet propulsion system is an auxiliary or supplemental propulsion system.

The present invention is embodied as a flying toy apparatus, comprising, a toy device having a tether mount receptacle, and an embedded simulated fan jet apparatus configured to propel the toy device. Furthermore, the embedded simulated fan jet may be composed of a simulated turbo fan mounted on bearings, a motor coupled to the simulated turbo fan and configured to rotate the simulated turbo fan, an energy reservoir for supplying fuel to said motor, and the toy itself includes at least one air channel configured to direct air from an output of the simulated turbo fan toward a back end of said toy device. In one embodiment, the energy reservoir is common battery power, and the toy includes a battery holding mechanism configured to hold batteries for powering the embedded simulated fan jet and having positive and negative terminals that are On/OFF switchably connected to corresponding terminals on an electric motor.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
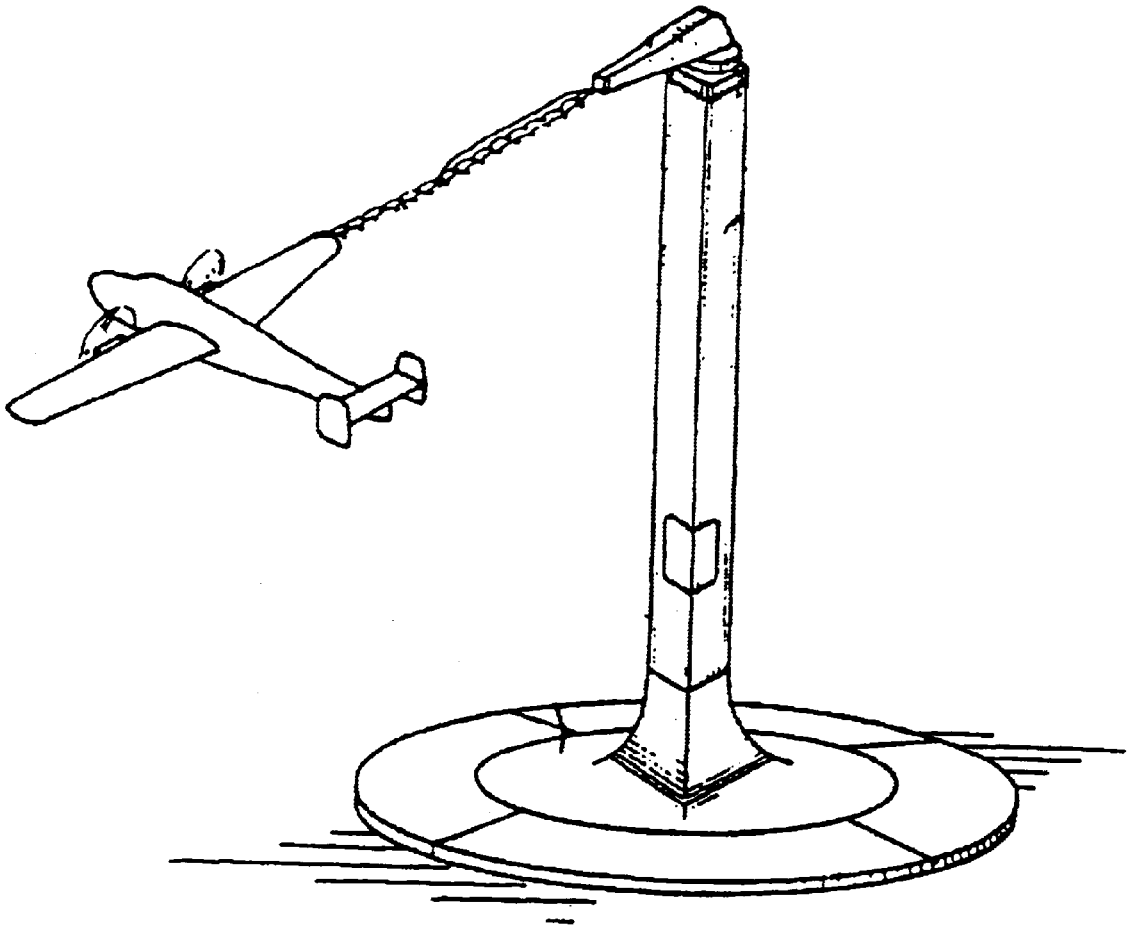
FIG. 1 is a figure of a conventional flying toy apparatus.
Figure 2:
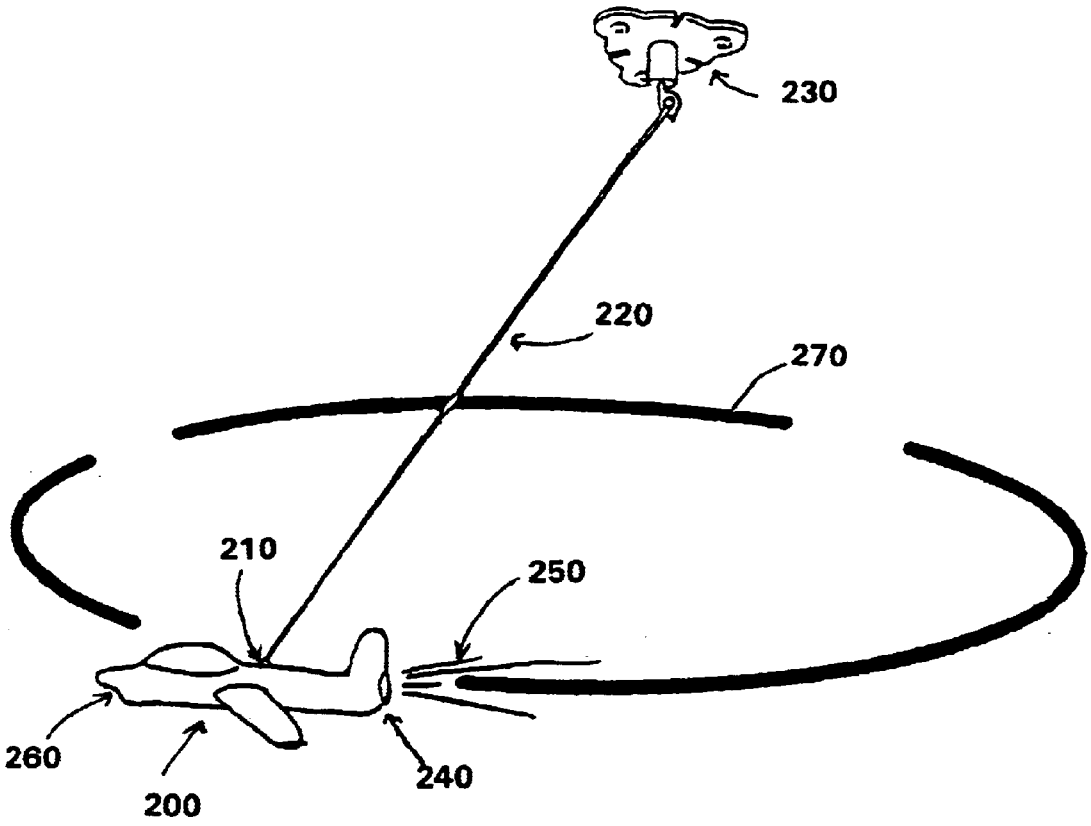
FIG. 2 is a drawing of an embodiment of simulated jet turbo fan powered flying toy according to the present invention.

Referring again to the drawings, wherein like reference numerals designate identical or corresponding parts, and more particularly to FIG. 2 thereof, there is illustrated an embodiment of simulated turbo fan powered flying toy 200 according to the present invention. The flying toy 200 is shaped like an airplane, but may be of other shapes or sizes.

The flying toy 200 includes an attachment point which may be constructed as an open loop upon which a first end of a tether 220 is attached. The open loop or another attachment mechanism or device may be utilized. A second end of the tether 220 is attached to a hanger or tether anchor 230. The hanger 230 includes an attachment point that is preferably mounted to a swivel mechanism.

An air based propulsion system is embedded in the flying toy 200. A jet exhaust port 240 provides an exit point for air 250 expelled from the air based propulsion system. An intake port (or air inlet) 260 feeds the air propulsion system. The expelled air 250 provides propulsion to the flying toy. In operation, the expelled air 250 pushes the flying toy 200, and the attached tether 220 guides the flying toy in a circular path 270.

Figure 3:
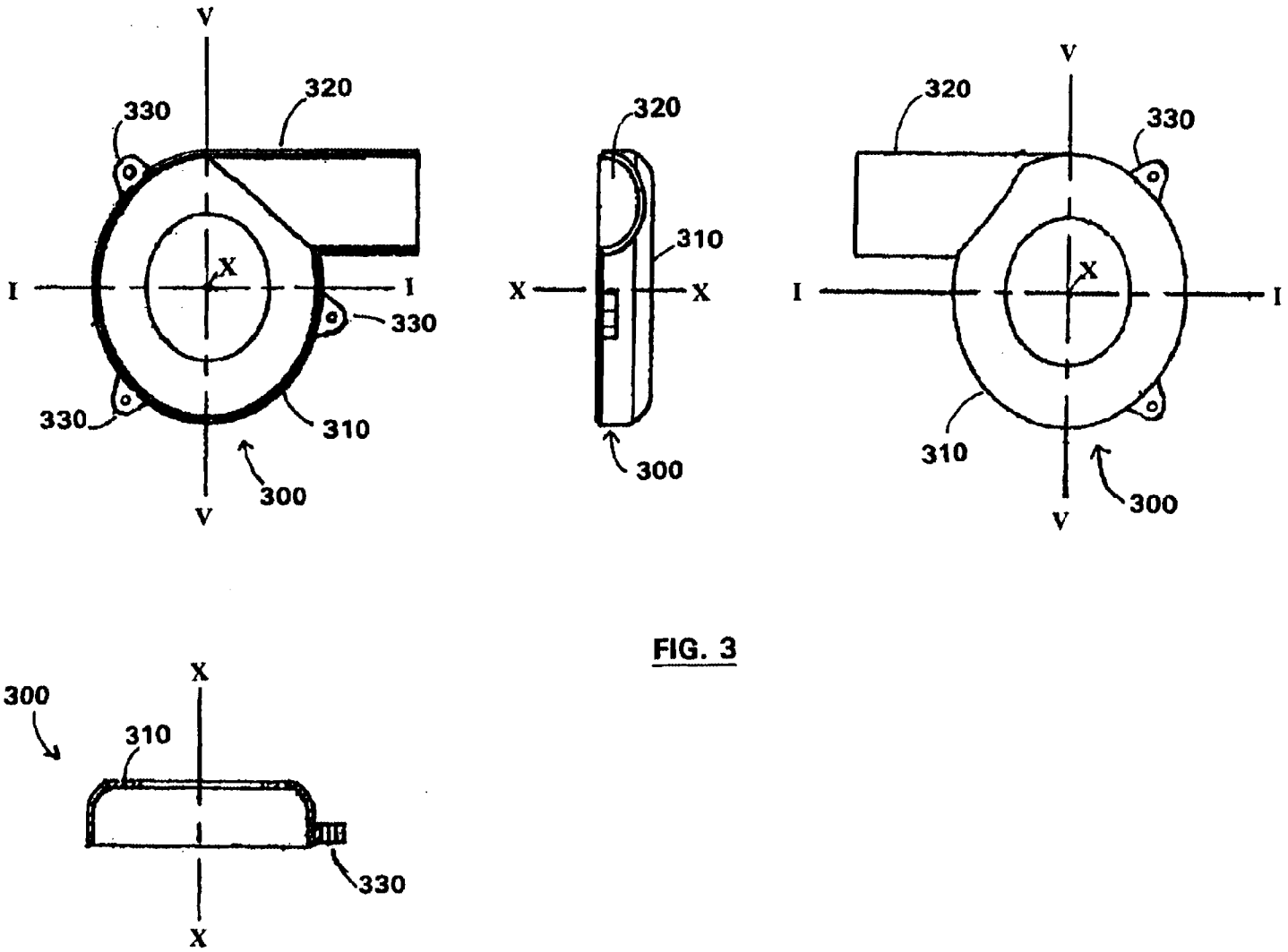
FIG. 3 is a sectional view of a simulated turbo fan housing according to an embodiment of the present invention.

In one embodiment, the air propulsion system is a simulated jet turbo fan device. FIG. 3 is a sectional view of a simulated jet turbo fan device 300 according to an embodiment of the present invention. As seen in FIG. 3, the simulated jet turbo fan in this embodiment is a hair dryer shaped blower. The simulated jet turbo fan 300 is an impeller driven fan housing having a circular enclosure 310 (that resembles a common hair dryer enclosure) with an exhaust port 320. Mounting points 330 are used to mount the simulated jet turbo fan inside the flying toy. In one embodiment, the hair dryer shaped blower is miniaturized so as to fit within the toy device and is powered by an electric motor that operates at battery powered level voltages.

Figure 4:
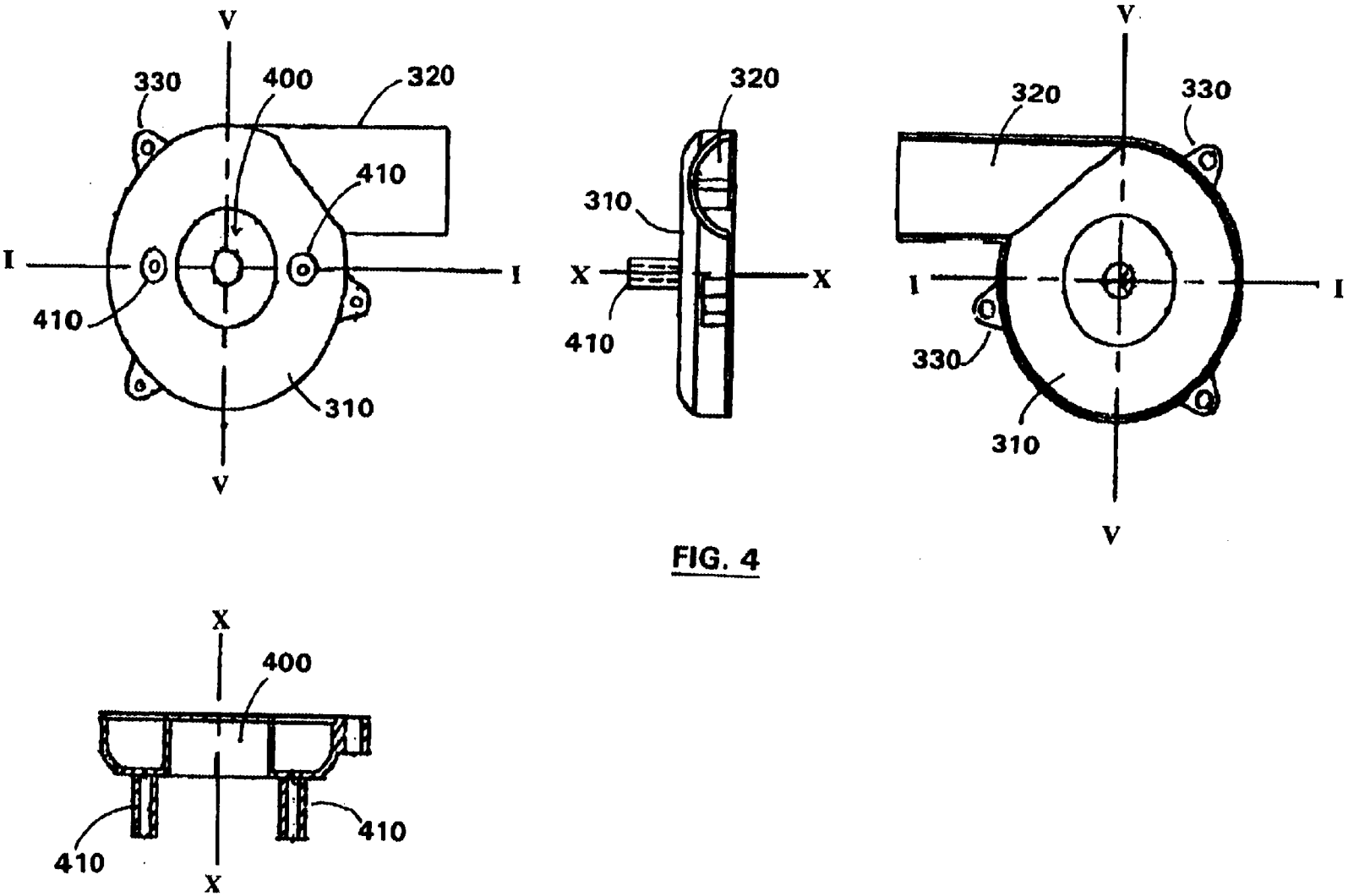
FIG. 4 is another sectional view of a simulated turbo fan housing according to the present invention.

FIG. 4 is another sectional view of a simulated jet turbo fan housing according to the present invention. A motor mounting area 400 is provided for mounting a motor for powering the simulated jet turbo fan. Mounting posts 410 are used to provide additional attachment points for the fan housing and to provide a fixed distance between a mounting part of the flying toy and the fan housing, providing space for the motor.

Preferably, the motor is an electric motor that fits within the motor mounting area 400. However, other motor types could be utilized, including wind up or rubber band powered motors, gasoline, jet engines, etc. With an electric motor, a power source is needed. As a power source, the flying toy includes a battery holder (not shown) for holding one or more batteries, and wiring that completes a circuit between the batteries and the electric motor. Alternatively, and external power source may be provided with wires running to the flying toy (wires attached and running along side the tether 220, for example).

Figure 5:
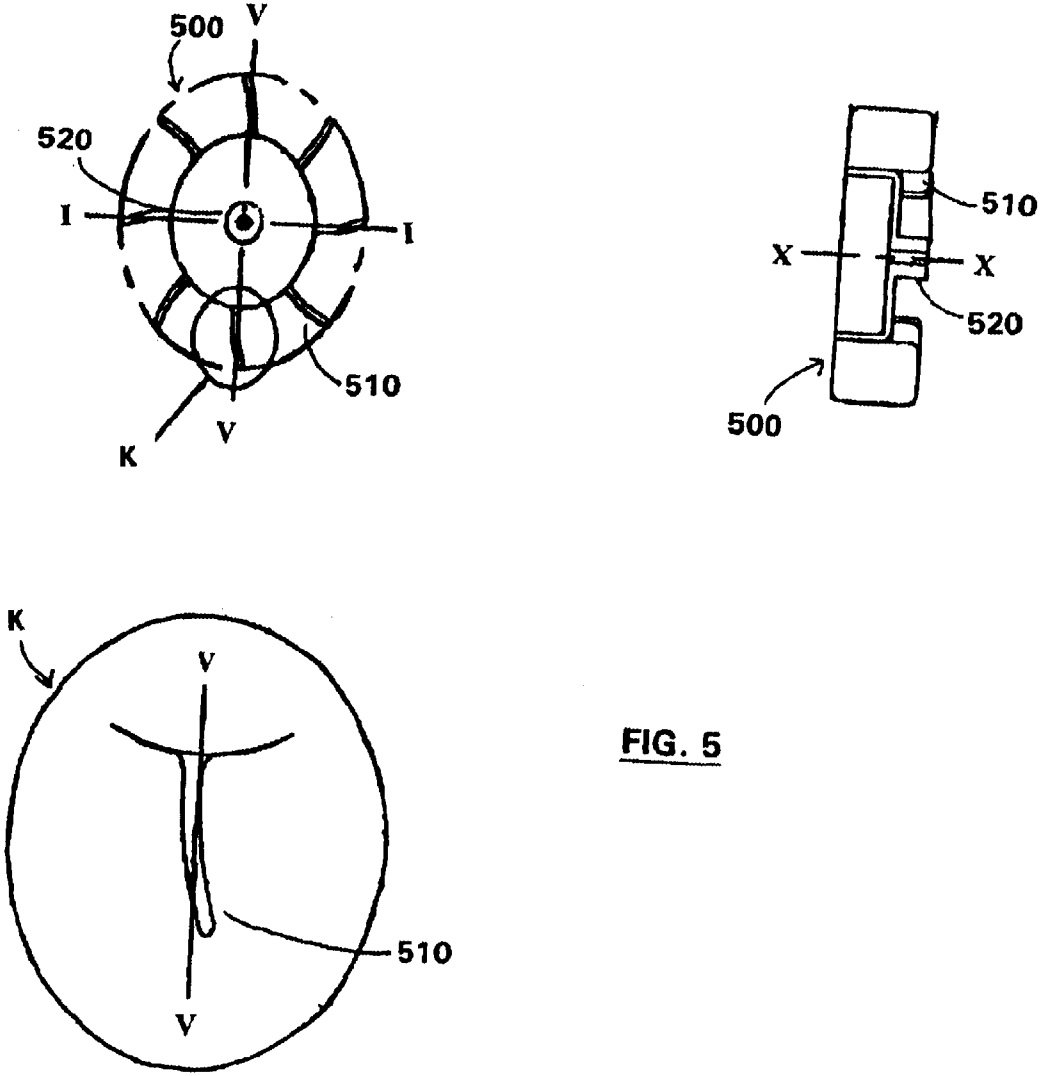
FIG. 5 is a drawing of views of an impeller and impeller blades used in the simulated turbo fan according to an embodiment of the present invention.

FIG. 5 is a drawing of views of an impeller 500 and impeller blades (510, for example) used in the simulated jet turbo fan according to an embodiment of the present invention. The impeller is contained inside the circular enclosure 310. The impeller is driven using the motor in a direct drive arrangement. A shaft receptor 520 is pressure fitted onto a shaft (not shown) of the motor, and the impeller is mounted inside housing 310. Other arrangements of powering the impeller may be utilized, including belt drive, or geared connections between the motor and impeller, for example. During operation the shaft of the motor rotates causing the impeller to rotate. The rotating impeller blades scoop up air and expel the scooped up air out the exhaust port (320, for example).

Figure 6:
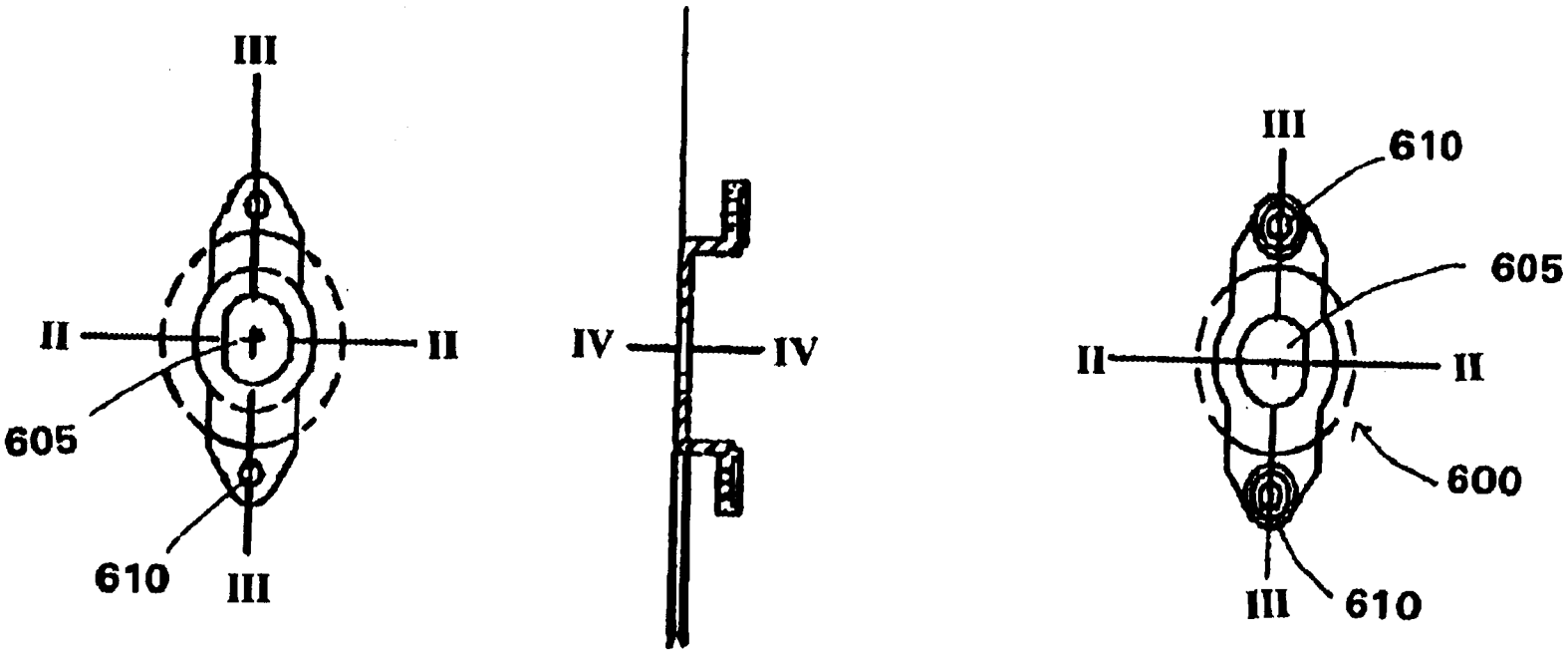
FIG. 6 is a drawing of an exhaust port of a simulated turbo fan according to the present invention.

FIG. 6 is a drawing of an embodiment of an exhaust port 600 of a simulated jet turbo fan according to the present invention. The exhaust port 600 includes an air exit 605 for expelling air driven by the impeller, and mounting holes 610 for securing the exhaust port (and entire simulated jet turbo fan structure) to the flying toy.

Figure 7:
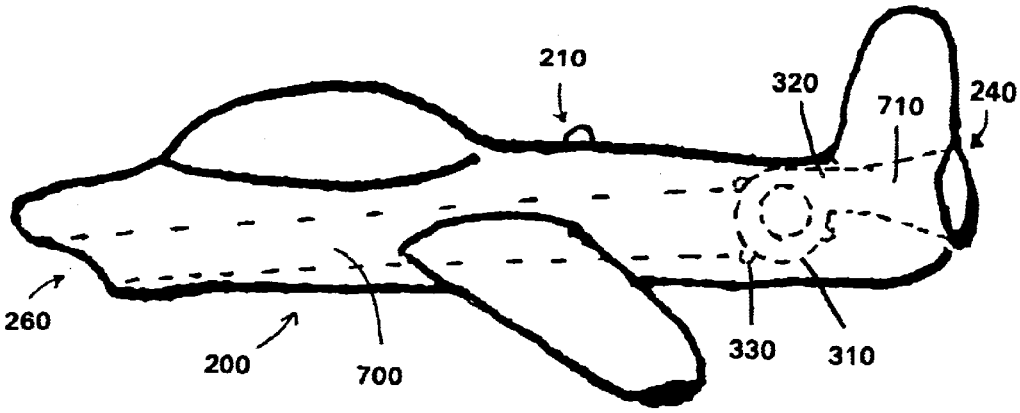
FIG. 7 is a drawing of a flying toy, including hidden view perspective of an embedded simulated jet turbo fan according to an embodiment of the present invention.

FIG. 7 is a drawing of a flying toy 200, including a hidden view perspective of an embedded simulated jet turbo fan 310 according to an embodiment of the present invention. The simulated jet turbo fan 310 along with the electric motor is mounted inside the flying toy 200. Air intake 260 is coupled to an air transfer channel 700 that feeds an air intake area of the simulated jet turbo fan 310. The air intake area is an area where the impeller blades scoop up the air from the transfer channel. The impeller then forces the scooped up air out exhaust port 320. Exhaust port 320 is either directly expels the forced air, or is coupled to an exhaust transfer port 710 which channels the expelled air to the jet exhaust port 240 of the flying toy.

Other arrangements for mounting the simulated jet turbo fan 310 and motor may be utilized. For example, the simulated jet turbo fan may be mounted on top of the flying toy (appropriate mounting points would be provided to match mounting holes 330, for example, or other mounting holes or attachment mechanisms could be implemented).

Figure 8:
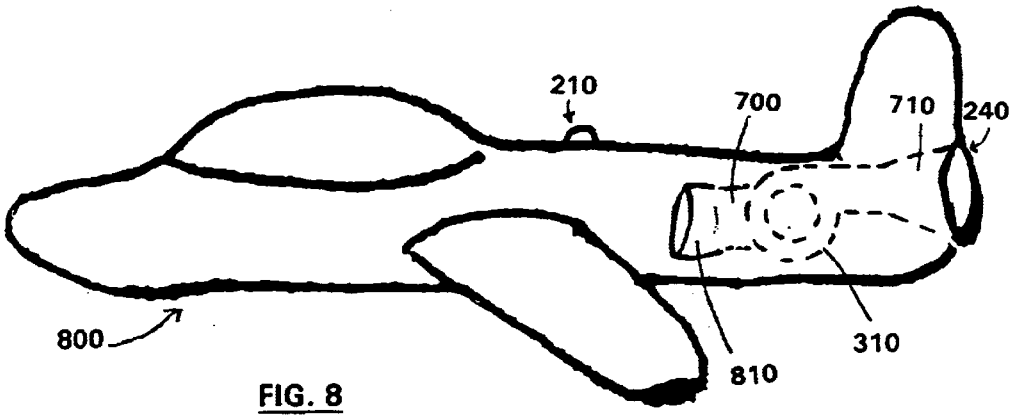
FIG. 8 is a drawing of an embedded simulated jet turbo fan according to the present invention.

FIG. 8 is a drawing of another embodiment of a flying toy 800 having an embedded simulated jet turbo fan 310 according to the present invention. The simulated jet turbo fan 310 is attached to air intake transfer channel 700 and exhaust transfer channel 710 similar to that shown in FIG. 7. Air inlet(s) 810 is a scoop mounted to a side of the flying toy for capturing new air to be expelled by the simulated jet turbo fan 310. In one embodiment, air inlets may be provided on both sides of the flying toy and incoming air is channeled via two corresponding air transfer channels to the air intake area of the simulated jet turbo fan. An advantage of the embodiment in FIG. 8 is a reduced air intake transfer channel length makes for a more efficient transfer of intake air to the simulated jet turbo fan 310.

Although the above described embodiments show the flying plane as an airplane, other flying objects may be used. For example, a helicopter, flying saucer, a pterodactyl or other object shaped similar to an object (animate or inanimate) normally associated with flight. In addition, the present invention is extended to items that are not normally associated with flight. For example, among other items, the present invention includes a "flying" Winnie the Pooh™ bear, a "flying" pig, and a "flying" cow (e.g., Holy Cows™).

Figure 9:
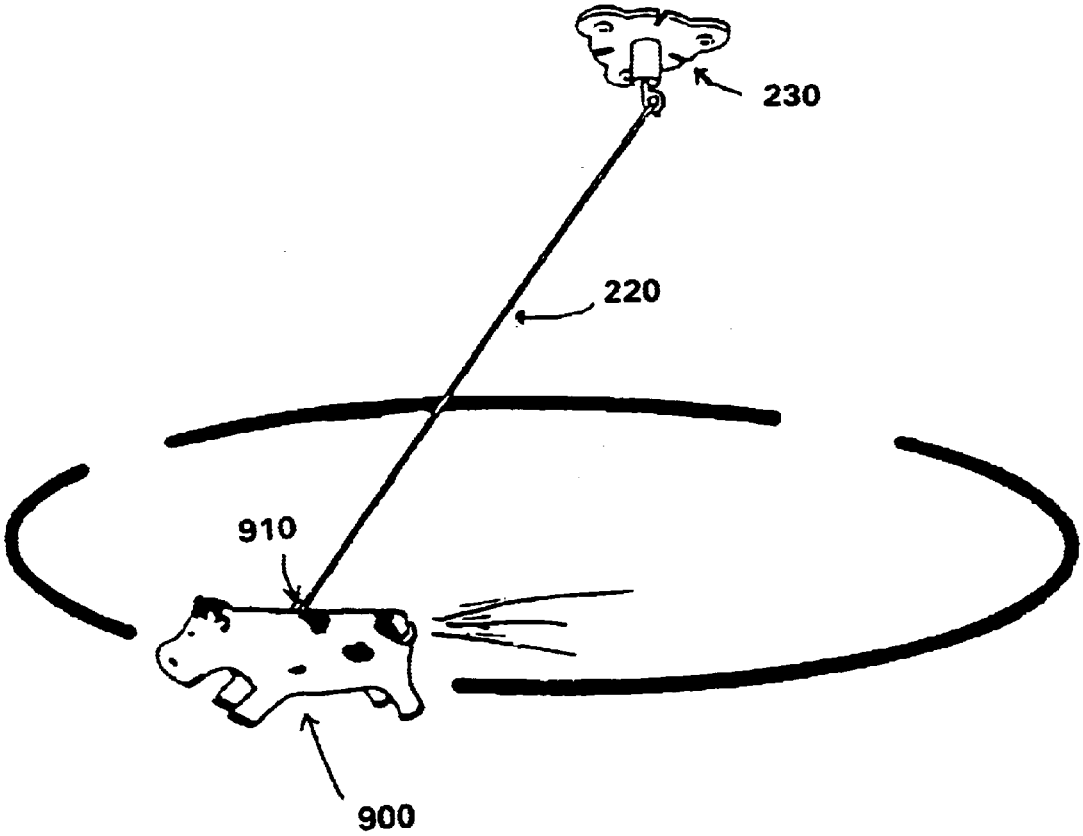
FIG. 9 is a drawing of another embodiment of a simulated jet turbo fan powered flying toy according to an embodiment of the present invention.

FIG. 9 is a drawing of another embodiment of a simulated turbo fan powered flying toy according to the present invention. FIG. 9 is a "flying" Cow (Holy Cow™) 900 configured according to the present invention. The simulated jet turbo fan is mounted in an interior of the Holy Cow™ 900, and the exhaust port is directed toward a back end of the Holy Cows™ 900. In one embodiment, the body of the Holy Cow™ 900 is shaped in a manner that assists in balanced rotation of the Holy Cow™ 900 during operation. Such assistance is found in aerodynamics that may include, for example, a more narrow front end, fin shaped legs, weighted body parts, and/or various placements of the tether attachment 910, any combination of which helps keep the rotation (or "flight") of the Holy Cow™ 900 more balanced.

Figure 10:
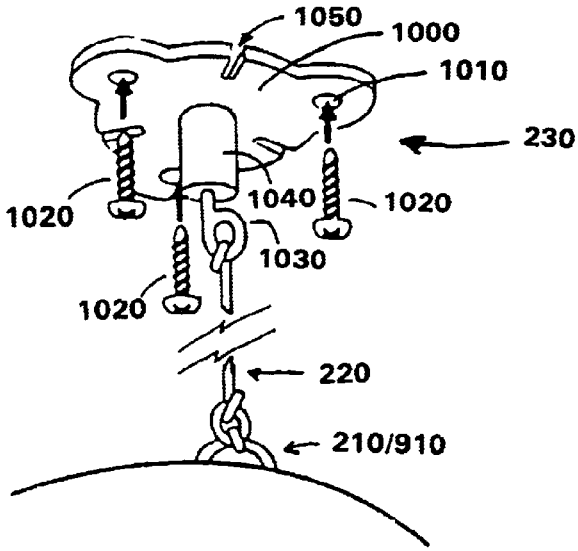
FIG. 10 is a detailed view of a hanger/tether anchor according to the present invention.

FIG. 10 is a detailed view of a hanger/tether anchor according to the present invention. The hanger/tether anchor 230 includes a base part 1000 having mounting holes 1010 that are secured to a ceiling or other mountable surface by inserting and securing attachment screws 1020 through the mounting holes into the mountable surface. Alternatively, glue, bolts, velcro, latches, or other securing mechanisms may be utilized. The base part 1000 includes expansion cuts 1050 to make mounting more secure on expanding/contracting or uneven mounting surfaces.

The tether anchor 230 includes an eye attachment 1030 to which the tether 220 is attached. The eye attachment is mounted in a bushing that holds the eye attachment in place and allows it to freely rotate. Free rotation of the eye attachment keeps the tether from being twisted which may cause the tether to wear. In one embodiment, both the tether base and attachment point on the flying toy (210, for example) have a swivel attachments that allow free rotation of the tether 200.

Figure 11:
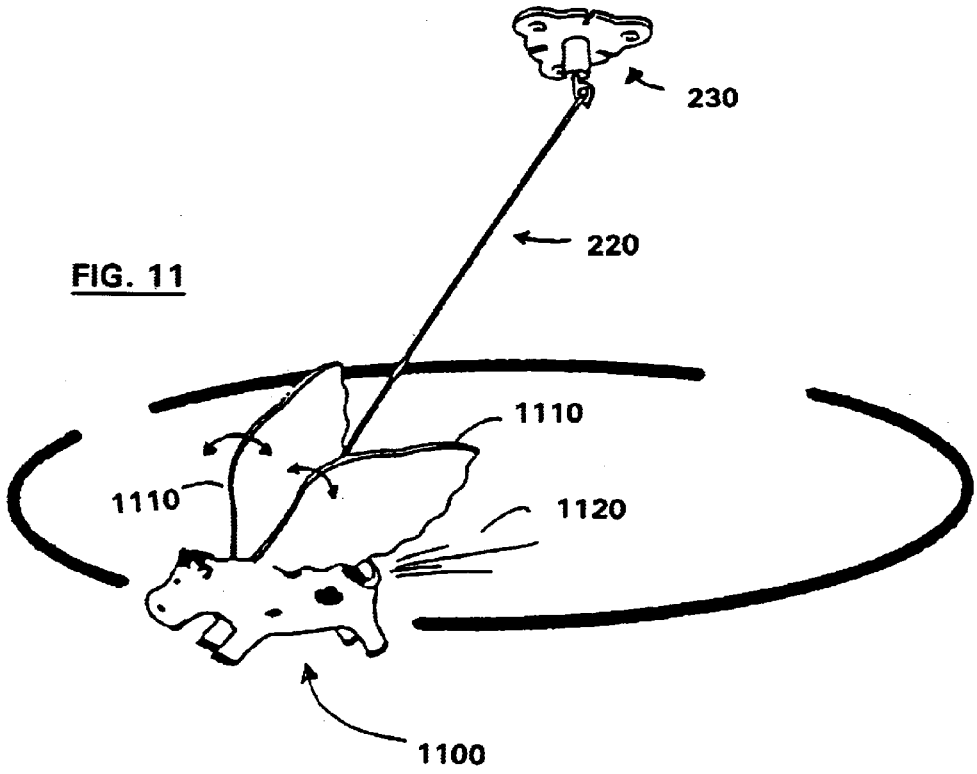
FIG. 11 is a drawing of an embodiment of a simulated jet turbo fan powered flying toy with flapping wings according to the present invention.

FIG. 11 is a drawing of an embodiment of a simulated turbo fan powered flying toy with flapping wings according to yet another embodiment of the present invention. A flapping wings only flying toy may have insufficient propulsion. Propulsion above and beyond that provided by an ordinary set of flapping wings is needed in order to achieve higher flight altitudes. The simulated jet turbo fan provides the needed additional propulsion. The combination of the simulated jet turbo fan propulsion and the flapping wings makes for an interesting toy to watch in flight. Not only does the toy fly exceptionally well, but the flapping wings add additional appeal for both children and adults.

The flying toy 1100 is similar to the Holy Cow™ 900 with the addition of flapping wings 1110. In one embodiment, the wings are constructed of fabric mounted on a plastic (or other material) frame (any set of toy wings could be substituted). In one embodiment, the wings are mounted on an up and down moveable device 1135 that is attached via a crankshaft 1150 and connecting rod 1145 to an electric motor 1155. In another embodiment, the frame is attached to a pivoting arm connected to a crankshaft type motor shaft. The motor, crankshaft, and pivoting arm cause the wings to flap up and down. The wings provide some propulsion to the flying toy, but are mainly an attractive feature of the toy, while air 1120 expelled by the simulated jet turbo fan provide the main amount of propulsion keeping the flying toy in flight. Aerodynamics of the wings help maintain balanced flight of the flying toy.

In one embodiment, the flying toy includes two electric motors, one for powering the flapping wings, and another for powering the simulated jet turbo fan. Both motors may derive energy from a single power supply, or each may have its own power supply (battery pack, for example). In this example, the energy reservoir is the batteries and the fuel is the electrons that flow from the batteries to the electric motor. In another embodiment,sa set of connecting rods or other mechanisms allow both the flapping wings and simulated jet turbo fan 310 to be powered by the same electric motor. The flying toy includes a switch for powering on and off the simulated jet turbo fan and flapping wings electric motor(s).

Obviously, numerous modifications and variations of the present invention are possible in light of the above teachings. It is therefore to be understood that within the scope of the appended claims, the invention may be practiced otherwise than as specifically described herein.

What is claimed and desired to be secured by Letters Patent of the United States is:

1. A flying toy apparatus, comprising:

a toy device having, a tether mount receptacle, an embedded blower assembly apparatus comprising an electric motor powered hair dryer shaped blower miniaturized so as to fit within the toy device, at least one air inlet coupled to an air intake of the embedded blower assembly, at least one exhaust outlet coupled to an exhaust of the embedded blower assembly, a battery holding mechanism configured to hold batteries for powering the embedded blower assembly and having + and − terminals that are On/OFF switchably connected to corresponding terminals on the electric motor;

a tether; and a tether plate with a tether attachment point;

wherein:

said tether plate, when mounted to a ceiling, provides a base from which to attach one end of said tether, another end of said tether being attached to said toy so as to cause said toy to "fly" in a circular or oval pattern when powered by the embedded blower assembly;

said flying toy includes wings;

said wings are mounted on an up and down movable device; and said electric motor is attached via a crankshaft and connecting rod to said up and down movable device.

2. The flying toy according to claim 1, wherein said toy device has an outer surface shaped as an inanimate object.

3. The flying toy according to claim 1, wherein said toy device has an outer surface shaped as an animated figure.

4. The flying toy according to claim 3, wherein said animated figure is a cow.

5. The flying toy according to claim 3, wherein said animated figure is a black and white cow.

6. The flying toy according to claim 3, wherein said animated figure is a pig.

7. The flying toy according to claim 3, wherein said animated figure is a pterodactyl.

* * * * *